US007661555B1

(12) United States Patent
Evans et al.

(10) Patent No.: US 7,661,555 B1
(45) Date of Patent: Feb. 16, 2010

(54) SINGLE DISPENSING FILM STRIP CONTAINER

(75) Inventors: Christopher T. Evans, Long Valley, NJ (US); Christopher Gieda, Long Valley, NJ (US)

(73) Assignee: Union Street Brand Packaging, Chester, NJ (US)

( * ) Notice: Subject to any disclaimer, the term of this patent is extended or adjusted under 35 U.S.C. 154(b) by 1004 days.

(21) Appl. No.: 10/734,587

(22) Filed: Dec. 15, 2003

Related U.S. Application Data

(60) Provisional application No. 60/433,006, filed on Dec. 13, 2002.

(51) Int. Cl.
*B65H 3/02* (2006.01)
*B65H 3/00* (2006.01)

(52) U.S. Cl. ..... 221/259; 221/37; 221/33; 221/269; 221/246; 221/210; 221/232; 221/65; 206/38; 206/39.4

(58) Field of Classification Search ..... 221/33, 221/259, 269, 246, 210, 232, 65, 249, 262, 221/270, 274, 32, 37, 136, 45; 206/38, 39.4, 206/1; 271/275, 33
See application file for complete search history.

(56) References Cited

U.S. PATENT DOCUMENTS

| | | | | | |
|---|---|---|---|---|---|
| 342,101 | A | * | 5/1886 | Hoyt | 221/26 |
| 646,726 | A | * | 4/1900 | Chelimer | 206/37 |
| 930,619 | A | * | 8/1909 | Russell | 221/36 |
| 933,663 | A | * | 9/1909 | Pollock | 221/41 |
| 2,588,152 | A | * | 3/1952 | Newman | 221/37 |
| 3,094,323 | A | * | 6/1963 | Catania | 271/33 |
| 3,140,777 | A | * | 7/1964 | Gordan | 206/315.1 |
| 3,276,622 | A | * | 10/1966 | Krzyzanowski | 221/37 |
| 3,517,855 | A | * | 6/1970 | Hillis | 221/259 |
| 4,071,165 | A | * | 1/1978 | Leopoldi | 221/259 |
| 4,121,726 | A | * | 10/1978 | Pemberton | 221/37 |
| 4,214,673 | A | * | 7/1980 | Heath et al. | 221/259 |
| 4,381,860 | A | * | 5/1983 | Silverberg | 271/120 |
| 4,626,092 | A | * | 12/1986 | Konno | 396/413 |
| 4,739,902 | A | * | 4/1988 | Joslyn et al. | 221/37 |
| 5,104,000 | A | * | 4/1992 | Goff | 221/191 |
| 5,197,630 | A | * | 3/1993 | Kirla | 221/37 |
| D372,723 | S | | 8/1996 | Schaefer et al. | |
| 5,687,876 | A | * | 11/1997 | Lucas, Jr. | 221/259 |
| D422,460 | S | | 4/2000 | Haner et al. | |
| D423,302 | S | | 4/2000 | Haner et al. | |

(Continued)

*Primary Examiner*—Gene O. Crawford
*Assistant Examiner*—Rakesh Kumar
(74) *Attorney, Agent, or Firm*—James Creighton Wray; Meera P. Narasimhan

(57) ABSTRACT

Moving a lid dispenses single thin films from a container. A pad coated with TPE, rubber or silicone rotates downward and contacts the top thin film strip. The pad moves the strip toward a front opening. When the lid is fully opened, the strip has been ejected far enough for the user to remove it. A sliding top and lever dispense a strip. The user slides back the top of the container, causing lever with a living hinges and links to flex downward. A pad rotates downward towards the top strip and outward towards an opening exposed in the front of the container and the strip is ejected out this opening. The pad is connected to a lever on a gear. Sliding the top of the container rotates the gear. The pad contacts the strip and moves the strip through the uncovered front dispensing opening.

12 Claims, 5 Drawing Sheets

U.S. PATENT DOCUMENTS 7,287,666 B2 * 10/2007 De Laforcade ..... 221/65
7,428,978 B2 * 9/2008 Lewis et al. ..... 221/39
2003/0121932 A1 * 7/2003 Wajda ..... 221/259

* cited by examiner

SINGLE DISPENSING FILM STRIP CONTAINER

This application claims the benefit of U.S. Provisional Application No. 60/433,006, filed Dec. 13, 2002.

BACKGROUND OF THE INVENTION

Containers for holding thin films and strips and other similar products are known in the art. However, there is a lack of effective methods for dispensing individual thin films and strips from storage containers. Current containers require a consumer to reach a finger into the container and attempt to extract a single thin film for use. Often, the consumer will extract multiple strips, requiring the consumer to replace the excess films. The films are not easy to handle and often become wrinkled, bunched up or otherwise misshapen and damaged. Additionally, because the consumer may need to touch the extra films, there is a risk of contamination.

Needs exist for improved containers and automatic methods of dispensing single strips of thin film products that are easy to use and eliminate contamination concerns.

SUMMARY OF THE INVENTION

The present invention is a thin film-dispensing container that ejects one thin film or strip at a time. The automatic, easy and reliable dispensing of one thin film at a time is advantageous when compared to previous containers due to ease of use. When only one strip is dispensed at a time there is less frustration at having to replace unused strips that were inadvertently dispensed. Further, because excess strips do not have to be handled, there is a reduced risk of contamination caused by touching the strips.

The thin film-dispensing container holds a stack of individual thin film strips. The strips are dispensed by lid opening mechanisms.

In one embodiment, the lid is raised or a lever is moved and an extension or a pad extending into the container is rotated downward to contact the top strip. The pad is coated with TPE, rubber or silicone to create friction with the top strip. As the lid is raised or moved further, the pad continues to swing toward the front opening and moves the top strip with it. When the lid is completely opened, the top strip is far enough out of the container to allow the user to grasp and remove it. The pad is returned to the start position when the user closes the lid.

In another embodiment, a lever mechanism is used. The user pulls back on the top of the container. A pad is connected to a living hinge within the container. The lever mechanism and the attached pad are forced downward and forward. As the lid is pulled further back, the pad moves the top strip toward the opening that is created by moving the lid backwards. When the top is pulled completely back, the strip is ready to be removed by the user. The top and lever return to the initial position when pressure removed by the user.

Another embodiment of the thin film-dispensing container involves a gear mechanism. Again, the user slides or pulls back on a part of the top cover of the container to operate a rack. The gear starts at the back of the rack region. A TPE, rubber or silicone tipped pad extension is attached to the gear in a fixed position. It begins in a horizontal position at the top of the container. As the gear is rotated forward, by the user sliding or pulling the top cover backward, the pad is rotated downward towards the thin films. The pad contacts the top film and moves it forward as the gear is rotated. When the top has been slid or pulled completely back, the strip is forced out of the opening created by moving the top backward. The user removes the strip. The container is prepared to dispense another strip by pushing the top of the container forward into the initial closed position.

A preferred strip dispenser has a container for holding a stack of strips. A lever is connected to the container and an extension is connected to the lever and extends into the container, A tip of the extension has a friction surface for engaging the top strip within the container. Lifting the lever moves the extension tip in the container and slides the extension tip outward from the container.

Preferably the lever is pivoted on a hinge connected to the container. The extension extends in a direction from the hinge opposite a direction of the lever. In one embodiment, the friction surface is one a side of the extension opposite from a top of the lever.

A dispensing opens and closes opening at one end of the container. A cover connected to the lever moves with the lever, closes the opening when the lever is aligned with the container, and uncovers the opening when an end of the lever is moved away from the container. Preferably the lever is a lid on an upper surface of the container for opening at least a part of the upper surface of the container. The preferred extension is flexible and has a relatively slippery surface on a side opposite the friction surface for sliding over a next adjacent strip on a return stroke.

The container holds a stack of aligned strips. A top strip in the stack slides along a next adjacent strip outward through the opening when the lever is moved. Preferably the dispensing opening extends substantially over an entire end of the container.

The lever is a lid hinged at one end to a central portion of a top of the container and extends outward to the opening in the end of the container for opening and exposing at least a portion of the stack of strips in the container.

In one form, a link is connected to the lever and to the extension. A slide is connected to a link and to the container for sliding on the container and uncovering an opening, and for moving the link, the lever and the extension, and moving the friction surface on the tip of the extension and one strip in the direction of the opening.

Living hinges interconnect the slide, the links and the lever. The lever is pivoted on an end of the container base at an end of the lever remote from the links, and at an end of the container base remote from the opening.

In one embodiment, a gear connected to the lever turns the lever and the extension as the gear is turned for moving the top strip. A slide connected to the container slides in a first direction to expose a dispensing opening. A rack on an inside of the slide turns the gear and moves the strip when sliding in the first direction. Sliding the top in a second direction closes the dispensing opening and turns the gear, the lever and the extension for sliding over a next adjacent strip.

A preferred method of dispensing a strip comprises an end of providing a container and a dispensing opening in the container, placing strips in the container, and engaging the top strip with friction surface on a tip of an extension extending into the container. Moving a lever connected to the container opens the dispensing opening, moves the extension and the tip in the direction of the opening, and moves the top strip and exposes it through the opening. Moving the lever and the extension in an opposite direction slides the side of the lip opposite the friction surface rearward over the next strip and closes the dispensing opening.

Initiating the moving of a lever moves the tip of the extension inward in the container and toward the at least one strip. Completing the moving of the lever and extension in the opposite direction moves the tip of the extension away from a next adjacent at least one strip. Moving the lever opens and closes the dispensing opening.

Sliding a slide opens and closes the dispensing opening and moves the lever and the extension with the slide.

In one method, the lever and the extension are connected to a gear which rotates in a cover of the container. Sliding the slide moves a rack across the gear and turns the gear for moving the lever and the extension.

The strips may be stacked or connected strips of any thickness, and the container may be of any size to accommodate the strips. The strips may be connected by weakened or perforated areas, or the cover may include a cutter to puncture, perforate or sever the strips. The strips may be in one continuous form as end-to-end connected strips. In the latter case, the strips may be dispensed in predetermined lengths or may be pulled outward to desired lengths before separation.

These and further and other objects and features of the invention are apparent in the disclosure, which includes the above and ongoing written specification, with the claims and the drawings.

DETAILED DESCRIPTION OF THE PREFERRED

Packaging for thin film strips uses a lid-activated mechanism to dispense one strip at a time.

Figure 1:
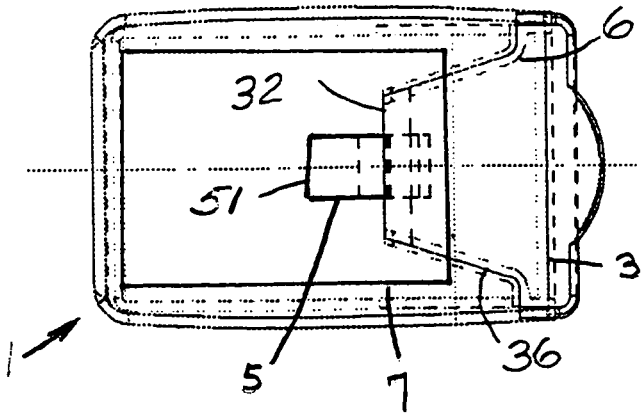
FIG. 1 is a top view of the packaging for thin film strips utilizing a lid-activated mechanism.
Figure 2A:
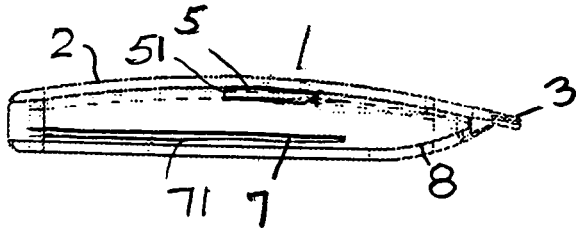
FIG. 2A is a side view of the packaging with the lid closed and the lid extension at the top of the container.
Figure 2B:
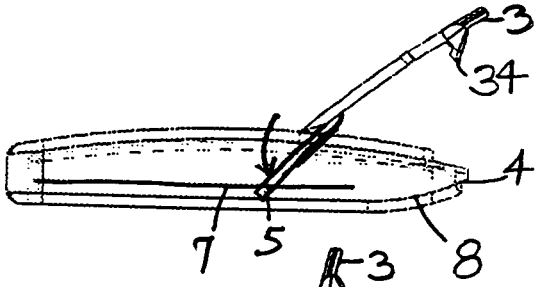
FIG. 2B is a side view of the packaging with the lid partially open and the lid extension contacting the thin film strips.
Figure 2C:
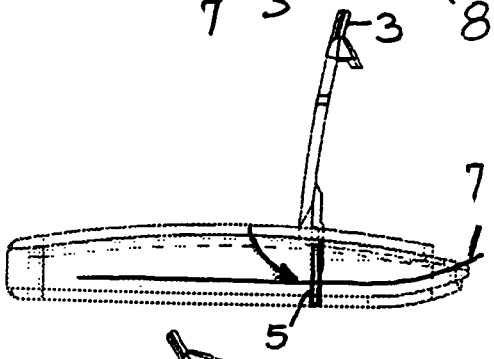
FIG. 2C is a side view of the packaging with the lid in a vertical position and the thin film strip being ejected.
Figure 2D:
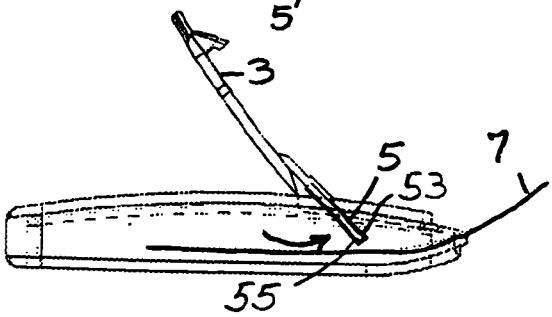
FIG. 2D is a side view of the packaging with the lid in the fully opened position and with the thin film strip ready to be removed.
Figure 3A:
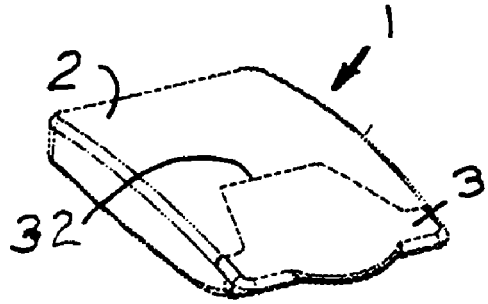
FIG. 3A is an oblique view of the packaging with the lid closed.
Figure 3B:
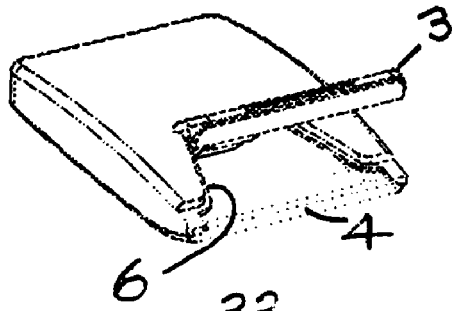
FIG. 3B is an oblique view of the packaging with the lid partially opened.
Figure 3C:
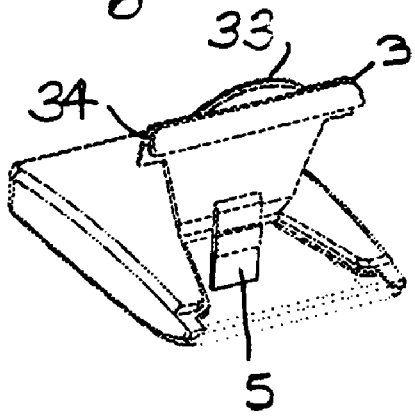
FIG. 3C is an oblique view of the packaging with the lid in a vertical position.
Figure 3D:
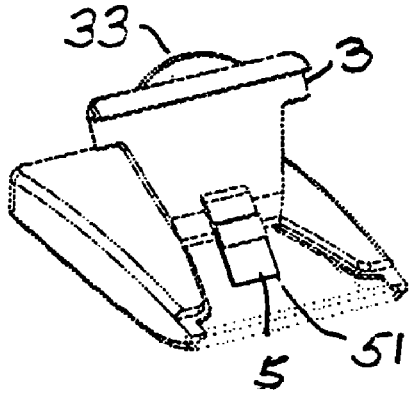
FIG. 3D is an oblique view of the packaging with the lid in a fully opened position.

In one embodiment, as shown in FIG. 1, lifting the lever 3, which in this embodiment acts as a lid, activates the dispensing mechanism 31. An extension 5 on the lid 3 extends into a container 1. A tip 51 of the extension 5 provides a friction surface made from or coated with a thermoplastic elastomer (TPE), rubber or silicone. One side 53 of the tip may be coated as a friction surface and the other side 55 may be left uncoated.

The use of the thin film dispensing container 1 is shown in FIGS. 2A, 2B, 2C and 2D. The lid 3 initially starts in the closed position with the extension 5 resting against the top wall 2 of the container 1. When a user lifts the lid 3 (FIG. 2B), the extension 5 swings downward and contacts the top strip 7 in the container 1. As the user continues to open the lid 3 (FIG. 2C) and further swings the extension towards the container opening, friction moves the strip 7 forward. When the lid 3 is completely open (FIG. 2D), a single strip 7 is out of the container far enough for a consumer to reach the strip 7, grasp an end of it and pull it from the container 1. When the lid 3 is closed, the extension 5 moves back to the starting position shown in FIG. 2A, ready to eject the next strip 7 upon the next opening of the lid 3.

In a preferred form as shown, the lid 3 has a generally truncated triangular shape with a living hinge 32 at one end joining the lid to the cover 2. The lid has a lip 33 which extends beyond a closure 34 that snaps over the end dispensing opening 4 in the end of the container 1. The tapered body 36 of the lid covers the opening 6 in the top of the container. The bottom 8 of the container curves upward near the dispensing opening to direct the top strip 7 and subsequent strips in stack 71 through the opening. The pad extension 5 flexes so that its tip slides over the next adjacent strip in stack 71 on its return and engages the uppermost strip 7 when the lip moves toward the opening 4.

FIGS. 3A, 3B, 3C and 3D show an oblique view of the thin film-dispensing container 1. The lid 3 is shown in operation, with the extension 5 starting in the horizontal position and moving downward and toward the front opening.

Figure 4:
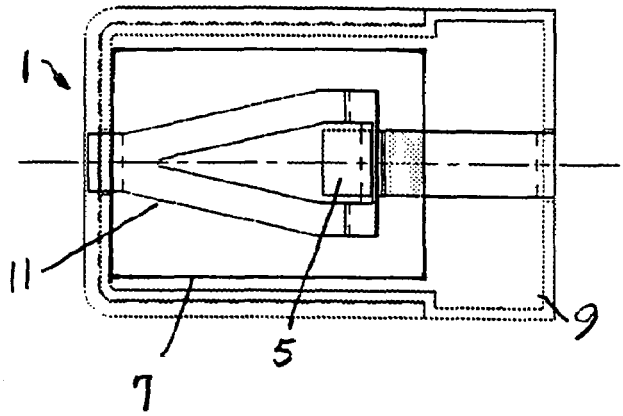
FIG. 4 is a top view of the packaging utilizing a lever mechanism.

A second embodiment, shown in FIG. 4, uses a hinged lever 11 and a sliding top 9. To operate the lever mechanism, the user pulls back on the sliding lid 9 on the upper surface of the container 1.

Figure 5A:
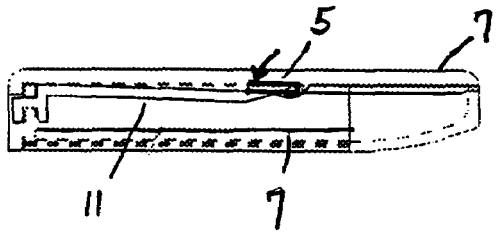
FIG. 5A is a side view of the packaging with the lid and the lever in the initial position.
Figure 5B:
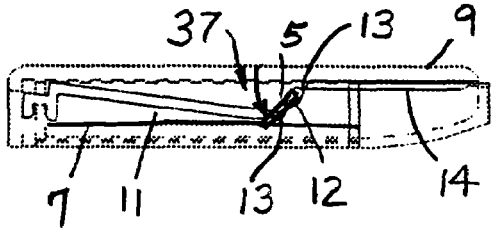
FIG. 5B is a side view of the packaging with the top being drawn back, the lever beginning to flex and the pad contacting the top thin film strip.
Figure 5C:
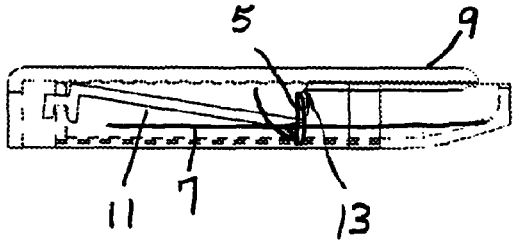
FIG. 5C is a side view of the packaging with the top further drawn back and the strip being moved forward.
Figure 5D:
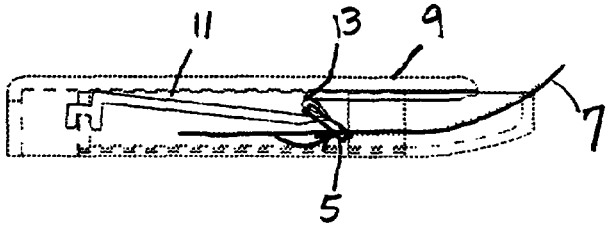
FIG. 5D is a side view of the packaging with the top completely drawn back, the lever fully flexed and the thin film strip ready to be removed.

FIGS. 5A, 5B, 5C and 5D show the operation of the thin film-dispensing container 1 utilizing the lever mechanism 37. The lever 11 and extension 5 originally start in the relaxed stored position, as shown in FIG. 5A, with the extension 5 against the upper surface of the container 1. Upon sliding back the lid 9, the lever 11 is depressed by a link 12, which moves the tip 51 of the extension 5 towards the strips 7. Living hinges 13 are formed between the lever 11, links 12 and 14 and the molded sliding top 9 of the container 1. The TPE, rubber or silicone tipped pad 5 is connected to link 12 between living hinges 13. As the lid 9, which is the top of the container, is slid backward, as shown in FIG. 5B, the lever 11 is pressed downward, and the pad 5 contacts the top strip 7. As shown in FIG. 5C, the cover 9 is further slid backward and as the lever 11, which has a fork engaging a rear wall of the container bottom, is pressed further, the link 12 and extension 5 are rotated downward and forward and the strip 7 is ejected out the front of container 1. The molded top 9 of the container slides back to uncover the dispensing opening 4 while depressing the lever 11. The device relaxes when pressure is released and returns to the start position. The top 9 is slid forward, closing dispensing opening 4 and pulling links 14 and 12 into aligned position.

Figure 6:
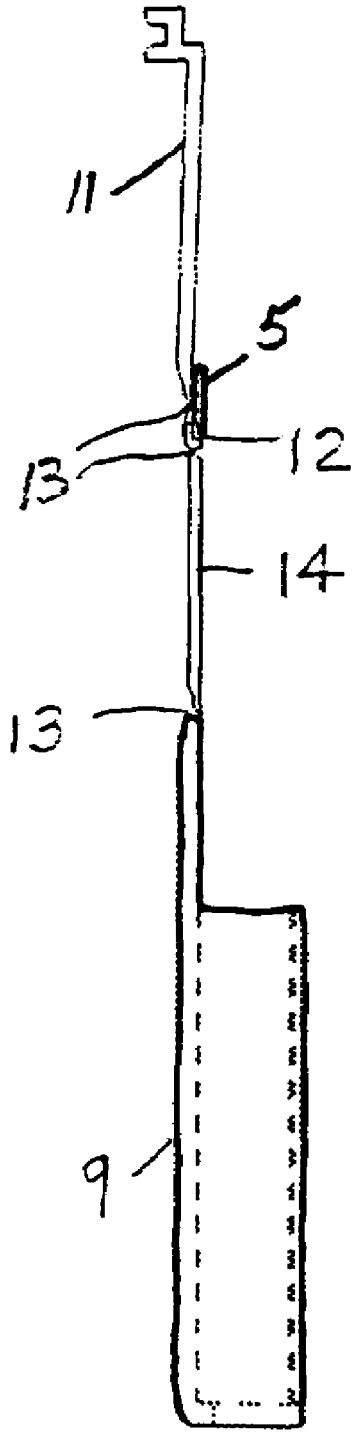
FIG. 6 is an enlarged view of the lever mechanism.

FIG. 6 is a detail of the lever mechanism 27 in molded position. The lever 11 is connected to the sliding top 9 through links 12 and 14 and living hinges 13. The pad 5 is attached to link 12 between living hinges 13. A living hinge 13 is attached between link 14 and the slidable molded top 9 of the container 1.

Figure 7:
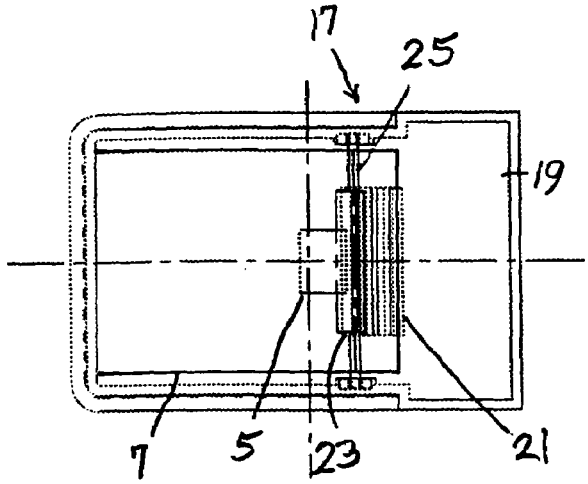
FIG. 7 is a top view of the packaging with the gear-activated mechanism.

As shown in FIG. 7, a third embodiment uses a gear-activated mechanism 17. To operate the thin film-dispensing container, the user pulls back on the sliding top 19 of the container 1.

Figure 8A:
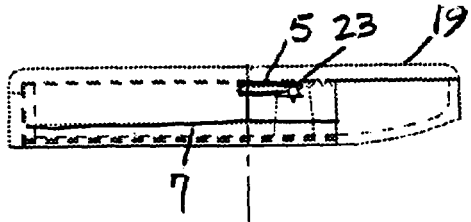
FIG. 8A is a side view of the packaging with the gear in the initial position.
Figure 8B:
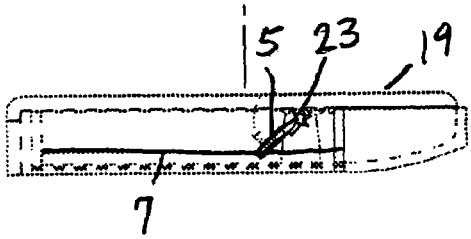
FIG. 8B is a side view of the packaging with the top being drawn back and the pad contacting the top thin film strip.
Figure 8C:
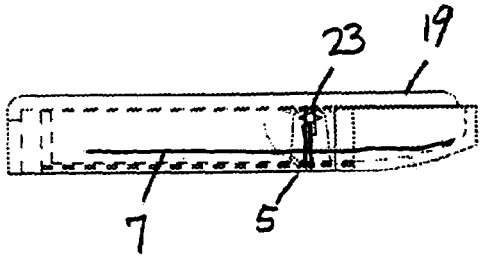
FIG. 8C is a side view of the packaging with the pad in a vertical position.
Figure 8D:
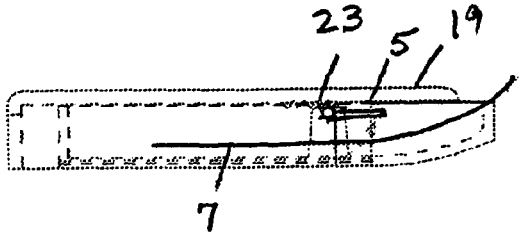
FIG. 8D is a side view of the packaging with the top drawn completely back and the strip ready for removal.

FIGS. 8A, 8B, 8C and 8D show the operation of the gear-activated mechanism 17. A user pulls back on top of container 19 to operate a sliding rack gear 21. A pinion gear 23 on a fixed or movable axle 25 starts at the back of the rack gear region 21. A TPE, rubber or silicone tipped pad 5, which is connected to the pinion gear 23, starts in a horizontal position at a top of the container 1, as shown in FIG. 8A. The pad 5 is attached to a lever 24 on the pinion gear 23 in a fixed position. As the pinion gear 23 is rotated forward by sliding back the top 19 and rack 21, the pad 5 is rotated downward towards the top strip 7, a shown in FIGS. 8B and 8C. The pad 5 contacts the top strip 7 and forces it forward. As the operator pulls back on the sliding top 19, dispensing opening 4 in the front of the container opens, allowing strip 7 to be ejected, as shown in FIG. 8D. When the operator pushes forward on the top 19 of the container, the dispensing opening 4 closes, and the rack gear 21 returns the pinion gear 23 and the pad 5 to the start position.

Operations and advantages of the three embodiments:

Packaging for thin film strips with lid-activated mechanism:
- dispenses one strip at a time
- lifting lid activates dispensing mechanism
- extension on lid extends into container
- tip of extension coated in rubber or silicone
- when lid is lifted, extension contacts top strip in container
- friction moves strip towards packaging opening
- when lid completely open, single strip is out far enough for consumer to reach
- when lid is closed, extension moves back to start position
- ready to eject next strip Lever mechanism:
- user pulls back on the upper surface of the container
- lever is depressed towards the strip
- a living hinge is between the lever and the molded front of the container
- the rubber or silicone tipped pad is on the living hinge
- as the lever is pressed down, the pad contacts the top strip
- as the lever is pressed further down and forward, the strip is ejected out the front of the container
- the molded front of the container slides back to reveal an opening opening during the depression of the lever
- the device relaxes when pressure is released
- returns to start position Gear-activated mechanism:
- user pulls back on top of container to operate
- gear starts at back of gear region
- rubber or silicone tipped pad starts horizontal at top of container
- pad attached to gear in fixed position
- as gear is rotated forward, pad is rotated downward towards the top strip
- pad contacts strip and forces it forward
- as operator pulls on top, front of container opens, allowing strip to be ejected
- when operator pushes forward on top of container, top closes and gear returns to start position While the invention has been described with reference to specific embodiments, modifications and variations of the invention may be constructed without departing from the scope of the invention, which is defined in the following claims.

We claim:

1. A strip dispenser comprising a container for holding at least one movable strip, a lever connected to the container, an extension connected to the lever and extending into the container, a tip of the extension having a friction surface for engaging the at least one strip within the container, whereby lifting the lever moves the tip of the extension in the container and slides the at least one movable strip outward from the container, wherein the lever is a cover and is pivoted on a hinge connected to the container, wherein the extension extends in a direction from the hinge opposite a direction of the lever.

2. A strip dispenser comprising a container for holding at least one movable strip, a lever connected to the container, an extension connected to the lever and extending into the container, a tip of the extension having a friction surface for engaging the at least one strip within the container, whereby moving the lever moves the tip of the extension in the container and slides the at least one movable strip outward from the container, wherein the friction surface is on a side of the extension opposite from the top of the lever and not another side of the extension, wherein the lever is a cover and is pivoted on a hinge connected to the container, and wherein the extension extends in a direction from the hinge opposite a direction of the lever.

3. The apparatus of claim 2, further comprising a dispensing opening at one end of the container and a closure connected to the lever for moving with the lever and closing the opening when the lever is aligned with the container, and for uncovering the opening when an end of the lever is moved away from the container.

4. The apparatus of claim 3, wherein the lever is a lid on an upper surface of the container for opening at least a part of the upper surface of the container.

5. The apparatus of claim 3, wherein the extension is flexible and has a relatively slippery surface on a side opposite the friction surface for sliding over a next adjacent strip.

6. The apparatus of claim 3, wherein the at least one strip comprises a stack of aligned strips, and wherein a top strip in the stack slides along a next adjacent strip outward through the opening when the lever is moved.

7. The apparatus of claim 6, wherein the dispensing opening extends substantially over an entire end of the container.

8. The apparatus of claim 7, wherein the lever comprises a lid hinged at one end to a central portion of a top of the container and extending outward to the opening in the end of the container for exposing at least a portion of the stack of strips in the container.

9. A method of dispensing a strip, comprising providing a container and a dispensing opening in the container, placing at least one strip in the container, providing a lever on the container, providing an extension connected to the lever and extending into the container, engaging the at least one strip with a friction surface on a tip of the extension extending into the container, moving the lever connected to the container, opening the dispensing opening, moving the extension and the tip of the extension in the direction of the dispensing opening, and sliding the at least one strip toward the dispensing opening and exposing the at least one strip through the opening, grasping and removing the exposed strip, moving the lever and the extension in an opposite direction and sliding a side of the tip opposite the friction surface over the at least one strip and closing the dispensing opening, wherein the lever is a cover and is pivoted on a hinge connected to the container, and wherein the extension extends in a direction from the hinge opposite a direction of the lever.

10. The method of claim 9, wherein initiating of the moving of the lever moves the tip of the extension inward in the container and toward the at least one strip, and wherein completing the moving of the lever and extension in the opposite direction moves the tip of the extension away from a next adjacent at least one strip.

11. A method of dispensing a strip, comprising providing a container and a dispensing opening in the container, placing at least one strip in the container, engaging the at least one strip with a friction surface on a tip of an extension extending into the container, moving a lever connected to the container, opening the dispensing opening, moving the extension and the tip of an extension in the direction of the dispensing opening, and sliding the at least one strip toward the dispensing opening and exposing the at least one strip through the opening, grasping and removing the exposed strip, moving the lever and the extension in an opposite direction and sliding a side of the tip opposite the friction surface over the at least one strip and closing the dispensing opening, further comprising opening and closing the dispensing opening by moving the lever and the extension, wherein the lever is a cover and is pivoted on a hinge connected to the container, and wherein the extension extends into the container in a direction opposite a direction of the lever.

12. A strip dispensing method, comprising providing a container holding several strips, providing a cover on the container, wherein the cover is a lever and is pivoted on a hinge connected to the container, providing an extension connected to the cover and extending into the container in a direction opposite a direction of the lever, providing a tip of the extension with a friction surface for engaging an upper strip within the container, whereby lifting the cover moves the tip of the extension in the container and slides the upper strip outward through an end opening in the container.

* * * * *